US005691028A

United States Patent [19]

Curtis

[11] Patent Number: 5,691,028

[45] Date of Patent: Nov. 25, 1997

[54] REMOVABLE SLEEVE FOR PADDING A HAZARDOUS-DUTY GARMENT STRAP

[75] Inventor: Nicholas J. Curtis, Dayton, Ohio

[73] Assignee: Lion Apparel, Inc., Dayton, Ohio

[21] Appl. No.: 555,613

[22] Filed: Nov. 9, 1995

[51] Int. Cl.[6] ..... A41D 27/26

[52] U.S. Cl. ..... 428/101; 428/34.1; 428/35.7; 428/36.1; 428/36.5; 428/102; 428/314.4; 428/318.4; 428/913; 2/268

[58] Field of Search ..... 428/34.1, 35.7, 428/36.1, 36.5, 101, 102, 314.4, 318.4, 913; 2/268

[56] References Cited

U.S. PATENT DOCUMENTS

| | | | |
|---|---|---|---|
| 148,744 | 3/1874 | Parent . | |
| 148,774 | 4/1874 | Parent . | |
| 330,519 | 11/1885 | Shenfield . | |
| 392,526 | 11/1888 | Sachs . | |
| 861,936 | 7/1907 | Batchelder . | |
| 877,332 | 1/1908 | Hayden . | |
| 1,972,533 | 9/1934 | Mix | 241/27 |
| 2,409,810 | 10/1946 | Stempel | 2/325 |
| 2,441,115 | 5/1948 | Lambert . | |
| 4,033,488 | 7/1977 | Brewer | 224/5 |
| 4,118,804 | 10/1978 | Freese | 2/340 |
| 4,125,904 | 11/1978 | Levine | 2/267 |
| 4,549,315 | 10/1985 | English et al. | 2/2 |
| 4,575,874 | 3/1986 | Johnson | 2/268 |
| 4,638,513 | 1/1987 | Woods | 2/268 |
| 4,688,643 | 8/1987 | Carter et al. | 169/33 |
| 4,850,057 | 7/1989 | Schierenbeck | 2/328 |
| 4,857,390 | 8/1989 | Allen et al. | 428/220 |
| 4,865,906 | 9/1989 | Smith, Jr. | 428/224 |
| 4,879,768 | 11/1989 | McClees et al. | 2/268 |
| 4,887,318 | 12/1989 | Weinreb | 2/268 |
| 4,897,886 | 2/1990 | Grilliot et al. | 2/81 |
| 4,922,552 | 5/1990 | Grilliot et al. | 2/93 |
| 4,967,421 | 11/1990 | Grilliot et al. | 2/327 |

FOREIGN PATENT DOCUMENTS

| | | |
|---|---|---|
| 1056553 | 6/1979 | Canada . |

OTHER PUBLICATIONS

FIG. 1 of German Pat. 317348 (publ Dec. 1919).

*Primary Examiner*—Kathleen Choi

*Attorney, Agent, or Firm*—Thompson Hine & Flory LLP

[57] ABSTRACT

A sleeve for padding a hazardous-duty garment strap, such as a firefighting suspender shoulder strap, or for padding a hazardous-duty pack strap, includes an elongated inner strip of padding material, an outer layer of heat and flame resistant material substantially surrounding the inner padding strip, and a central passage shaped to slidably receive the strap of the garment or pack strap therethrough. In a preferred embodiment, the padding is made of heat and flame resistant closed cell foam material, and the outer layer is made of an aramid material.

4 Claims, 1 Drawing Sheet

REMOVABLE SLEEVE FOR PADDING A HAZARDOUS-DUTY GARMENT STRAP

BACKGROUND

The present invention relates to hazardous-duty garments and, more particularly, to a padding sleeve for hazardous-duty pant suspender shoulder straps, or other hazardous-duty support straps.

A typical firefighting ensemble comprises a turnout coat, pants and a set of suspenders for supporting the pants. The pants supported by the suspenders can become heavy due to absorbed moisture, and accordingly, it is preferable that the shoulder straps of the suspenders be padded to provide comfort to the wearer.

Typically, the padding for the shoulder straps of the firefighting suspenders is not removable from the shoulder straps, such as that shown in Kleinman U.S. Pat. Nos. 5,386,593 and 5,129,105. The padding shown in those patents is integrated into one unitary strap. A disadvantage with that structure is that, should the strap or the padding become damaged, the padding and strap cannot be separated and replaced with an undamaged article. In addition, the padding of such a unitary structure cannot be removed from the strap for cleaning. Furthermore, it would be advantageous to have a strap which can be easily incorporated into an non-padded set of suspenders.

Accordingly, there is a need for a removable padding for a hazardous-duty shoulder strap.

SUMMARY OF THE INVENTION

The present invention is a removable sleeve for padding a hazardous-duty garment shoulder strap, a hazardous-duty suspender shoulder strap, or a hazardous-duty shoulder strap for equipment, such as self-contained breathing apparatus. The sleeve is adapted for use in hazardous-duty situations and is removable and slidable along its associated strap.

In accordance with the present invention, a sleeve for padding hazardous-duty garment strap or a hazardous-duty equipment strap comprises an elongated inner strip of padding material, an outer layer of heat and flame resistant material substantially surrounding the inner padding strip, and means for slidably attaching the sleeve to the strap.

In a preferred embodiment of the invention, the sleeve comprises an elongated strip of closed-cell foam padding folded longitudinally upon itself to form a passage extending substantially longitudinally therethrough and shaped to slidably receive the strap, and an outer shell of an aramid fiber material substantially surrounding the folded padding strip and attached thereto by lamination or stitching along the sides of the strip. The closed-cell foam resists absorbing moisture and is flame and heat resistant, yet is sufficiently resilient to provide comfort.

The outer shell typically is constructed of flame and heat resistant material such as woven aramid and/or polybenzamidazole ("PBI") fibers. Commercially available aramid fibers are NOMEX and KEVLAR (both are trademarks of E. I. DuPont de Nemours & Company, Inc.).

Accordingly, it is an object of the present invention to provide a padded sleeve which is removable from a set of hazardous-duty suspenders and which is adapted to be worn to meet specific hazardous-duty performance requirements; a hazardous-duty padding sleeve that will not take on additional weight by significantly absorbing moisture; a hazardous-duty padding sleeve which can be easily incorporated into an non-padded set of hazardous-duty suspenders; and a removable padding sleeve which is relatively inexpensive to manufacture and install.

Other objects and advantages of the present invention will be apparent from the following description, the accompanying drawings and the appended claims.

DETAILED DESCRIPTION

Figure 1:
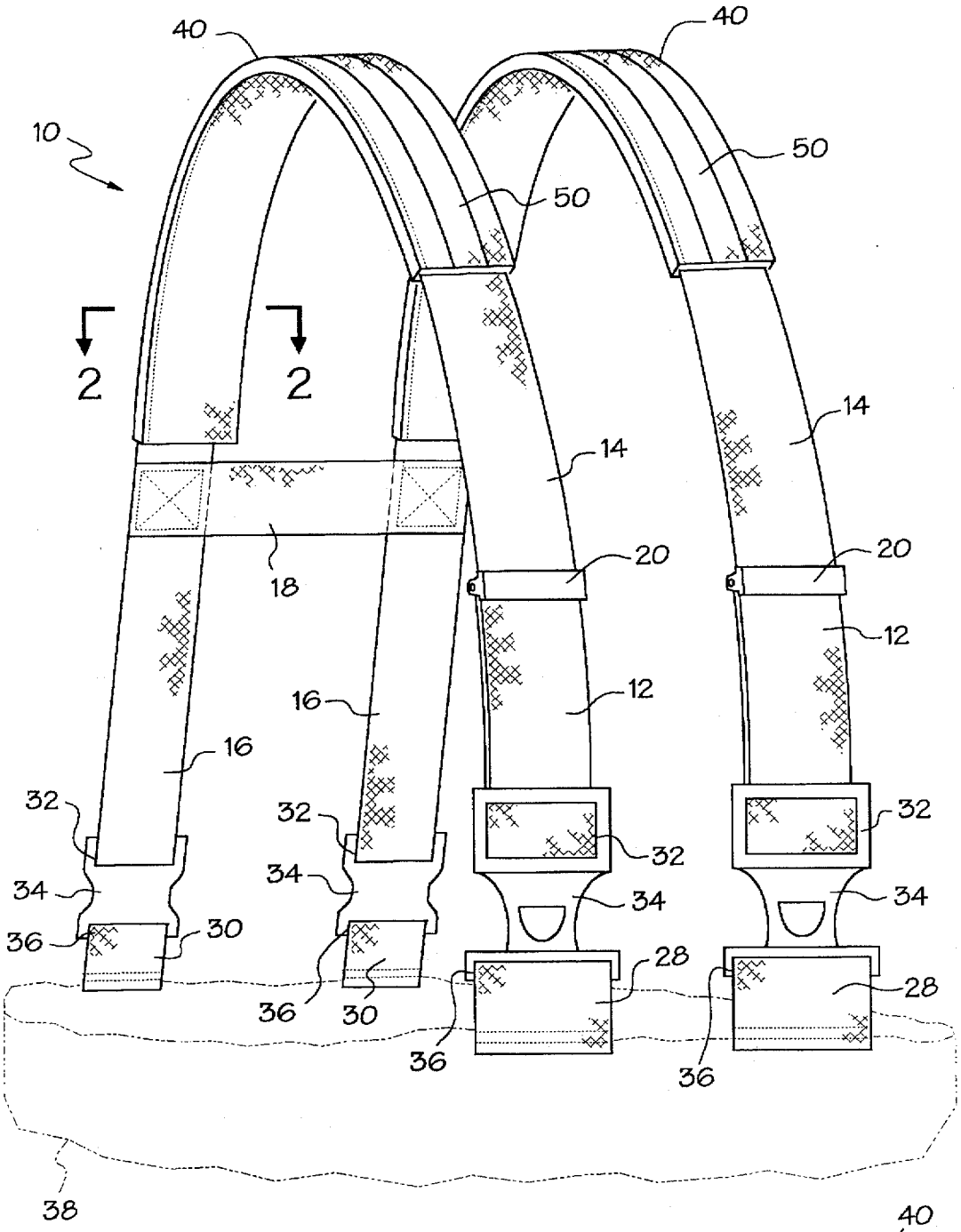
FIG. 1 is a perspective view of a preferred embodiment of the present invention for use with a pair of a firefighting suspenders.

As shown in FIG. 1, a pair of suspenders, generally designated 10, comprises a pair of front straps 12 having portions 14 extending over the shoulder of a wearer, a pair of back straps 16, and a horizontal or cross strap 18. The front strap 12 is preferably constructed from a non-stretch, durable fiber webbing, such as nylon. The back and cross straps 16,18 are preferably constructed from an elastic, durable fiber webbing, such as nylon.

The front straps 12 terminate in buckles or "keepers" 20 which are adjustably mounted on the shoulder portions 14. The shoulder portions 14 are attached to the back straps 16 by stitching each pair to an end of the horizontal strap 18. The front straps 12 and back straps 16 are looped through upper eyes 32 of pant couplers 34, and pant attachment strips 28, 30 are looped through lower eyes 36 of the pant couplers which are preferably constructed from a thermoplastic material. The attachment strips 28, 30 are preferably stitched to pants 38, shown in phantom. The lengths of straps 12 can be adjusted in a conventional manner, by positioning the keepers 20 along the straps 12.

Figure 2:
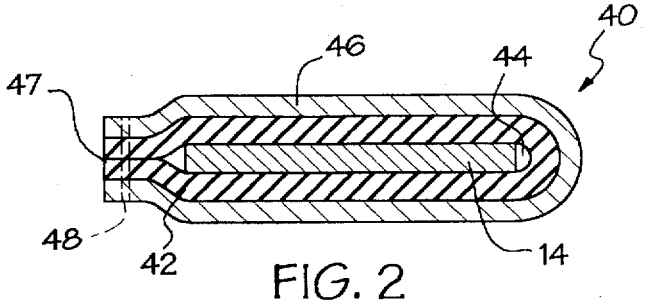
FIG. 2 is a cross-sectional view taken along line 2—2 of FIG. 1.

The preferred embodiment of the present invention is a pair of padded sleeves 40, slidably attached over the shoulder straps 14 of the suspenders 10. As shown in FIG. 2, each padded sleeve 40 is constructed of a strip of closed cell foam padding 42 longitudinally folded over upon itself to form a passage 44 for slidably receiving the shoulder strap 14 therethrough. An outer shell 46 of aramid material is sewn or laminated by a suitable adhesive to the padding material 42 and the composite material is stitched along a longitudinal side 47 by thread 48.

The outer shell 46 is preferably constructed of a flame and heat resistant material such as woven aramid and/or PBI fibers. Commercially available aramid fibers are NOMEX and KEVLAR. The thread 48 is preferably an aramid fiber. The strip 42 of closed cell foam padding preferably is a neoprene or polyvinyl nitrile foam which has been treated to make it sufficiently flame and heat resistant to function in a firefighter garment. Such foam is described in co-pending U.S. Patent application Ser. No. 08/119,474 filed Sep. 10, 1993, the disclosure of which is incorporated herein by reference. An appropriate closed-cell foam material for the strip 42 is ENSOLITE brand closed cell foam, styles IV 1, IV 2, IV 3, IV 4, IV 5, GIC and IVC, manufactured by Ensolite, Inc. of Mishawaka, Ind.

One important aspect of the padding layer formed by the strip 42 is that it does not appreciably absorb moisture, and therefore does not take on added moisture weight in a wet environment. Furthermore, the closed-cell structure resists compression better than an open cell foam, and is more resilient than solid neoprene or polyvinyl nitrile.

The construction of the sleeve 40 allows the sleeve to be slidable over the shoulder strap 14 and thus facilitates the easy attachment, adjustment and removal of the sleeve 40 to and from the suspenders 10. Therefore, if the padding 42 is damaged, the damaged padding can be easily removed and an undamaged padding can be reattached easily to the sleeve 40; or if the suspenders are damaged, the undamaged padding can be removed from the damaged suspenders and mounted on a pair of undamaged suspenders. Furthermore, the removability of the sleeve facilitates easy cleaning and maintenance of the padding.

The foam material preferably is non-apertured, but in an alternate embodiment may be apertured to reduce weight or increase air permeability of the padding. Such apertured foam is disclosed in copending U.S. Ser. No. 081119,474, the disclosure of which is incorporated herein by reference.

Also in the preferred embodiment, the sleeves 40 include strips 50 of reflective material stitched to the upper, outer surfaces of the shells 46. The strips 50 increase night and low light visibility of a wearer.

While the sleeves 40 are preferably used for padding firefighting suspender shoulder straps 14, it is within the scope of the invention that the padding sleeves be used in other forms of hazardous garment straps or shoulder straps or similar straps for hazardous-duty bags, packs or self-contained breathing apparatus (s.c.b.a.) equipment.

Having described the invention in detail and by reference to the drawings, it will be apparent that modification and variations are possible without departing from the scope of the invention as defined in the following claims.

What is claimed is:

1. A sleeve for padding a hazardous-duty garment support strap, comprising:

an elongated inner strip of substantially heat and flame-resistant closed cell foam padding material; and an outer layer of abrasion, heat and flame resistant material substantially surrounding said inner padding strip;

said sleeve being shaped to be slidably attached to said strap; and said outer layer material being selected from a group consisting of an aramid polymer material, a polybenzamidazole material, and a blend of aramid polymer material and polybenzamidazole material.

2. A sleeve for padding a hazardous-duty garment strap or a hazardous duty pack strap, comprising:

an elongated strip of substantially heat and flame-resistant, closed cell foam padding folded longitudinally upon itself to form a passage extending longitudinally through said folded strip for slidably receiving the strap; and an outer shell of abrasion, heat and flame resistant material substantially surrounding said folded padding strip and attached to said folded padding strip by stitching;

said outer shell material being selected from a group consisting of an aramid polymer material, a polybenzamidazole material, and a blend of aramid polymer material and polybenzamidazole material.

3. A sleeve for padding a firefighter suspenders shoulder strap, comprising:

an elongated, substantially heat and flame-resistant, closed cell foam padding member having an aperture extending substantially longitudinally through said padding member for slidably receiving the strap; and an outer layer of heat, flame, and abrasion resistant material substantially surrounding said padding member, said outer layer material being selected from a group consisting of an aramid polymer material, a polybenzamidazole material, and a blend of aramid polymer material and polybenzamidazole material;

whereby said outer layer protects the sleeve and strap from heat and flames when the sleeve is in use by a firefighter in high heat and flame environments.

4. A sleeve for padding a firefighter pant suspender strap, comprising:

an outer shell of heat, flame and abrasion resistant material selected from a group consisting of an aramid polymer material, a polybenzamidazole material, and a blend of aramid polymer material and polybenzamidazole material; and an inner layer of heat and flame resistant closed cell foam material;

said outer shell and inner layer being bonded to each other to form a laminate strip, said laminate strip being folded over on itself to form a sleeve having a central opening to slidably receive a suspender strap therethrough.

* * * * *